US008182356B2

(12) United States Patent
Hylton et al.

(10) Patent No.: US 8,182,356 B2
(45) Date of Patent: May 22, 2012

(54) THERAPEUTIC SWING

(76) Inventors: Jason B. Hylton, Wake Forest, NC (US); Charles Hylton, Covington, VA (US)

( * ) Notice: Subject to any disclaimer, the term of this patent is extended or adjusted under 35 U.S.C. 154(b) by 121 days.

(21) Appl. No.: 12/651,478

(22) Filed: Jan. 3, 2010

(65) Prior Publication Data

US 2011/0165952 A1 Jul. 7, 2011

(51) Int. Cl.
*A63G 9/00* (2006.01)
*A63H 33/00* (2006.01)

(52) U.S. Cl. ..... 472/118

(58) Field of Classification Search ..... 472/92, 472/94, 118–125; 446/70–74, 227
See application file for complete search history.

(56) References Cited

U.S. PATENT DOCUMENTS

| | | | | |
|---|---|---|---|---|
| 1,390,502 | A | 9/1921 | Clouser | |
| 1,906,768 | A | 5/1933 | Romine | |
| 2,366,135 | A | 12/1944 | Vermette | |
| 3,486,751 | A | 12/1969 | Hatfield et al. | |
| 4,188,745 | A * | 2/1980 | Harvey et al. | 446/227 |
| 4,784,383 | A | 11/1988 | Roberts | |
| 5,161,522 | A | 11/1992 | Clevenger | |
| 5,531,656 | A | 7/1996 | Varghese | |
| 6,110,048 | A | 8/2000 | Murray | |
| 6,277,028 | B1 | 8/2001 | Liu | |
| 6,702,643 | B1 * | 3/2004 | Drosendahl et al. | 446/227 |
| 6,933,036 | B2 * | 8/2005 | Whitaker | 428/141 |
| 6,997,815 | B2 | 2/2006 | Devine | |
| 7,040,995 | B2 | 5/2006 | Lee | |
| 7,117,552 | B2 * | 10/2006 | Hoffman | 5/655 |
| 7,172,512 | B2 | 2/2007 | Be | |
| 7,189,164 | B1 | 3/2007 | Paesang et al. | |
| 7,238,148 | B2 | 7/2007 | Simmons | |
| 7,302,724 | B2 * | 12/2007 | Solomon et al. | 5/655 |
| 2009/0017718 | A1 * | 1/2009 | Bryan et al. | 446/227 |

* cited by examiner

*Primary Examiner* — Kien Nguyen
(74) *Attorney, Agent, or Firm* — The Parker Law Office, PLLC; DeLeon Parker, Jr.

(57) ABSTRACT

A portable therapeutic vestibular swing device comprising a rigid component frame having a seat pivotally suspended therefrom, support members depending downwardly with each support member having a foot distal from a horizontal shaft adapted, each foot adapted for insertion in an individual one of a plurality of pocket means of a flexible load-bearing base.

13 Claims, 6 Drawing Sheets

THERAPEUTIC SWING

BACKGROUND OF THE INVENTION

1. Field of Invention

This invention relates generally to swings, and more particularly to vestibular swings for therapeutic use and the like.

2. Description of the Prior Art

Individuals and occupational therapists use vestibular swings in therapy to treat a range of sensory disorders. More particularly, "Swing Therapy" is a method of vestibular stimulation used as a component of a broader range of therapies for a range of autism spectrum disorders such as autism, Asperger syndrome, attention deficit hyperactive disorder (ADHD), atypical autism (pervasive developmental disorder not otherwise specified or PDD-NOS). For example, research indicates vestibular therapy using swings is effective in producing spontaneous vocalizations from autistic children.

Swing frames tend to be large, immobile, and consume a significant amount of floor space. For these reasons, vestibular swings are frequently permanently mounted to a wall, floor or ceiling structural member when used indoors. These factors also limit the indoor use of vestibular swings to situations involving sufficient space where the frame is usually permanently or semi-permanently erected. The cost of such frames and swings can also be prohibitive for some.

While a large footprint and sturdy construction facilitates use of a swing by older children, the size and immobility limit their use the permanent or semi-permanent settings. Heretofore, no therapeutic vestibular swing is suitable for portable therapeutic use with a limited footprint.

SUMMARY OF THE INVENTION

The present invention is directed to swing devices, and more particularly to a portable therapeutic vestibular swing.

DETAILED DESCRIPTION OF THE INVENTION

Figure 1:
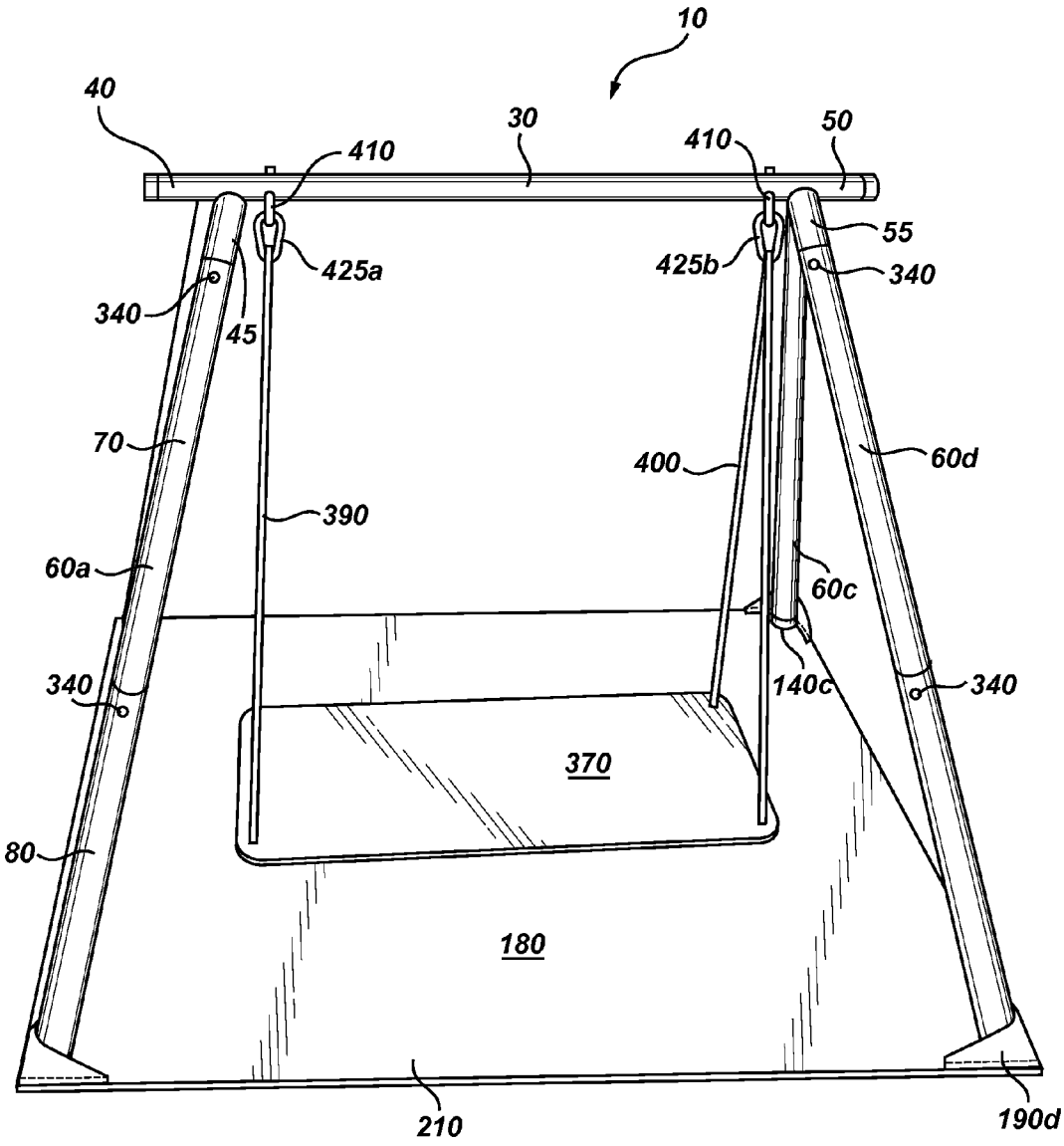
FIG. 1 is a front plan view of an embodiment of the device.
Figure 2:
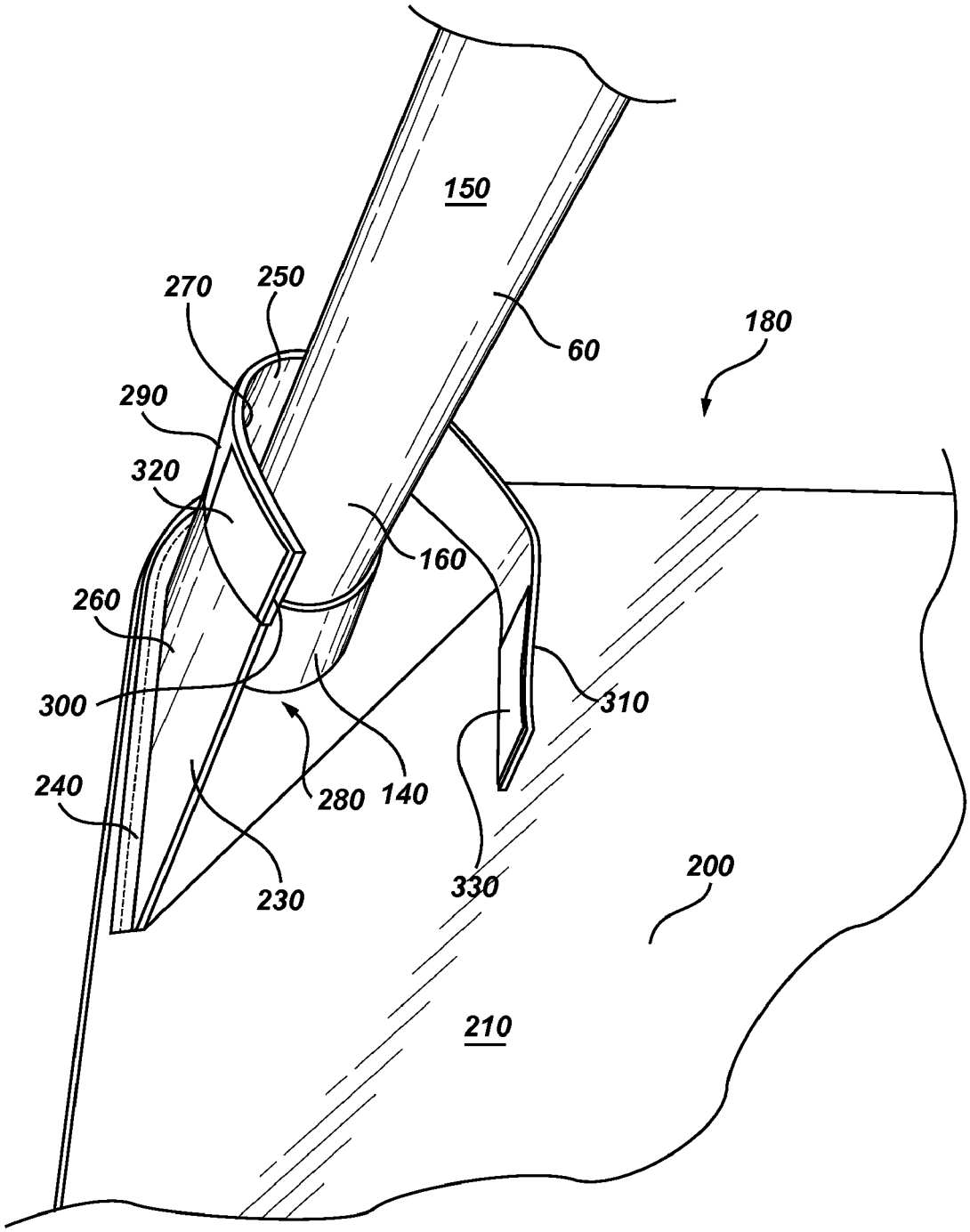
FIG. 2 is a perspective view of an embodiment of a pocket means having a support member inserted therein showing an unsecured strap.
Figure 3:
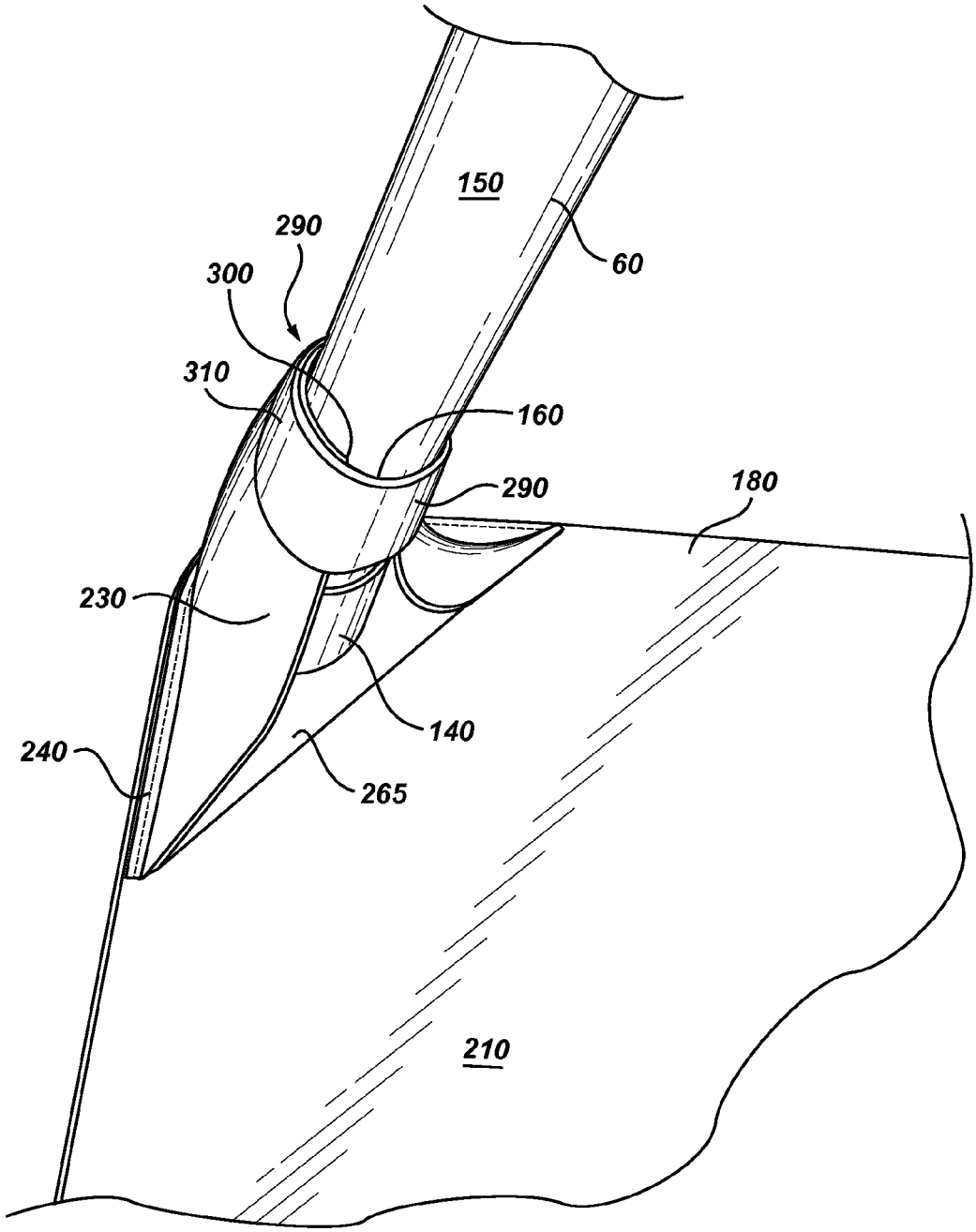
FIG. 3 is a perspective view of an embodiment of a pocket means having a support member inserted therein wherein the strap is secured.
Figure 4:
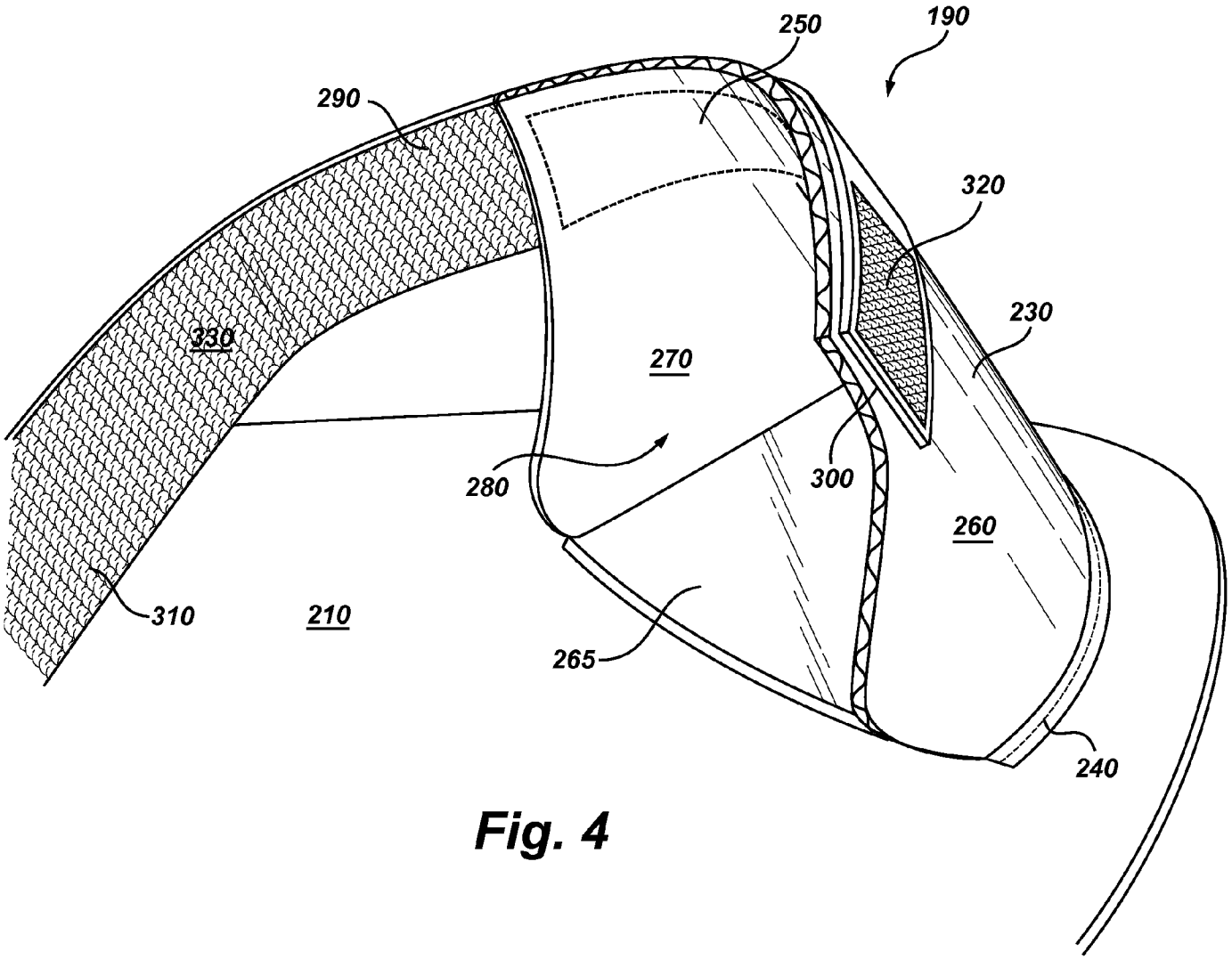
FIG. 4 is a perspective view of an alternative pocket means as used in an embodiment of the device.
Figure 5:
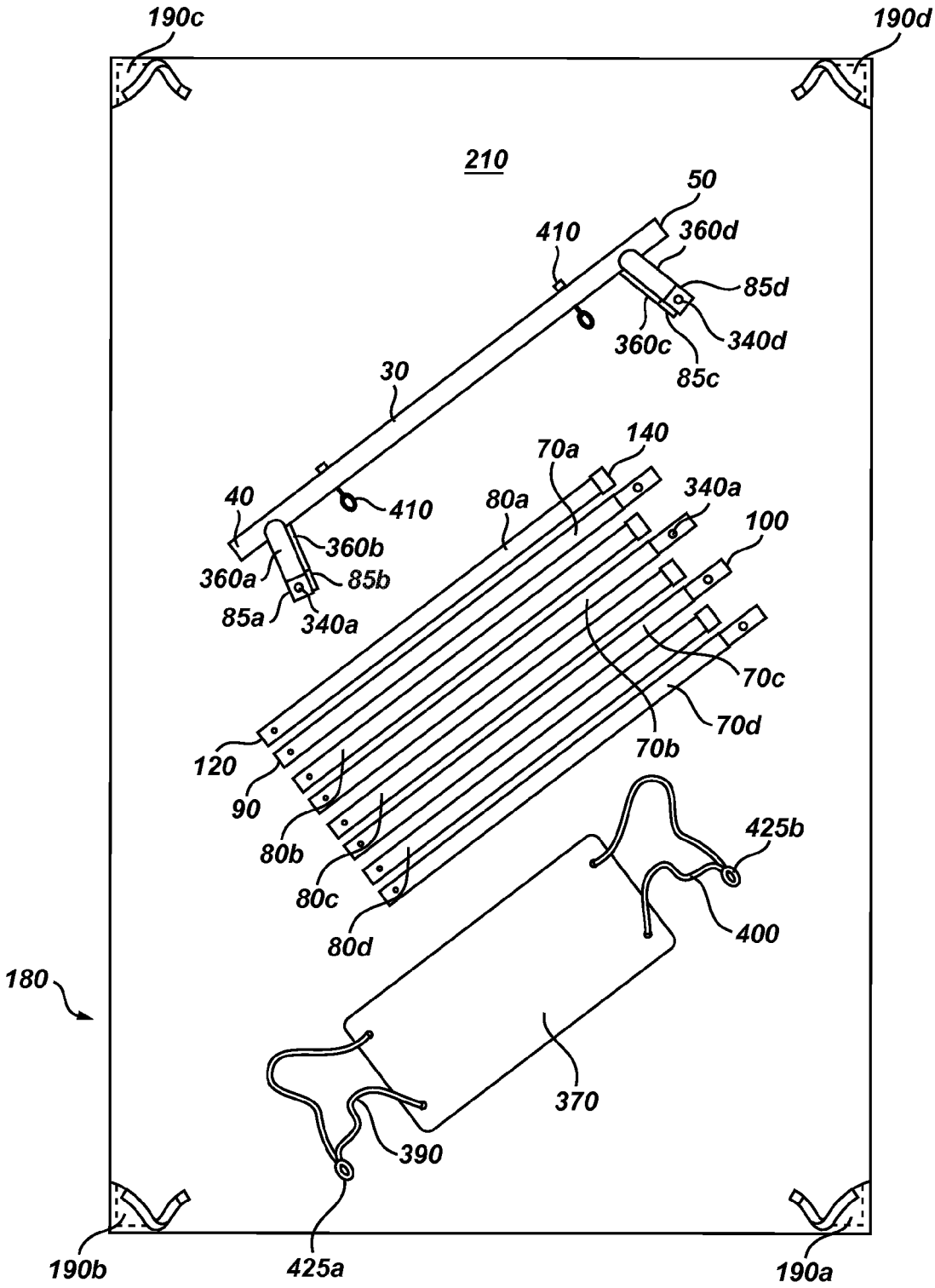
FIG. 5 is a perspective view of a disassembled embodiment of the device.
Figure 6:
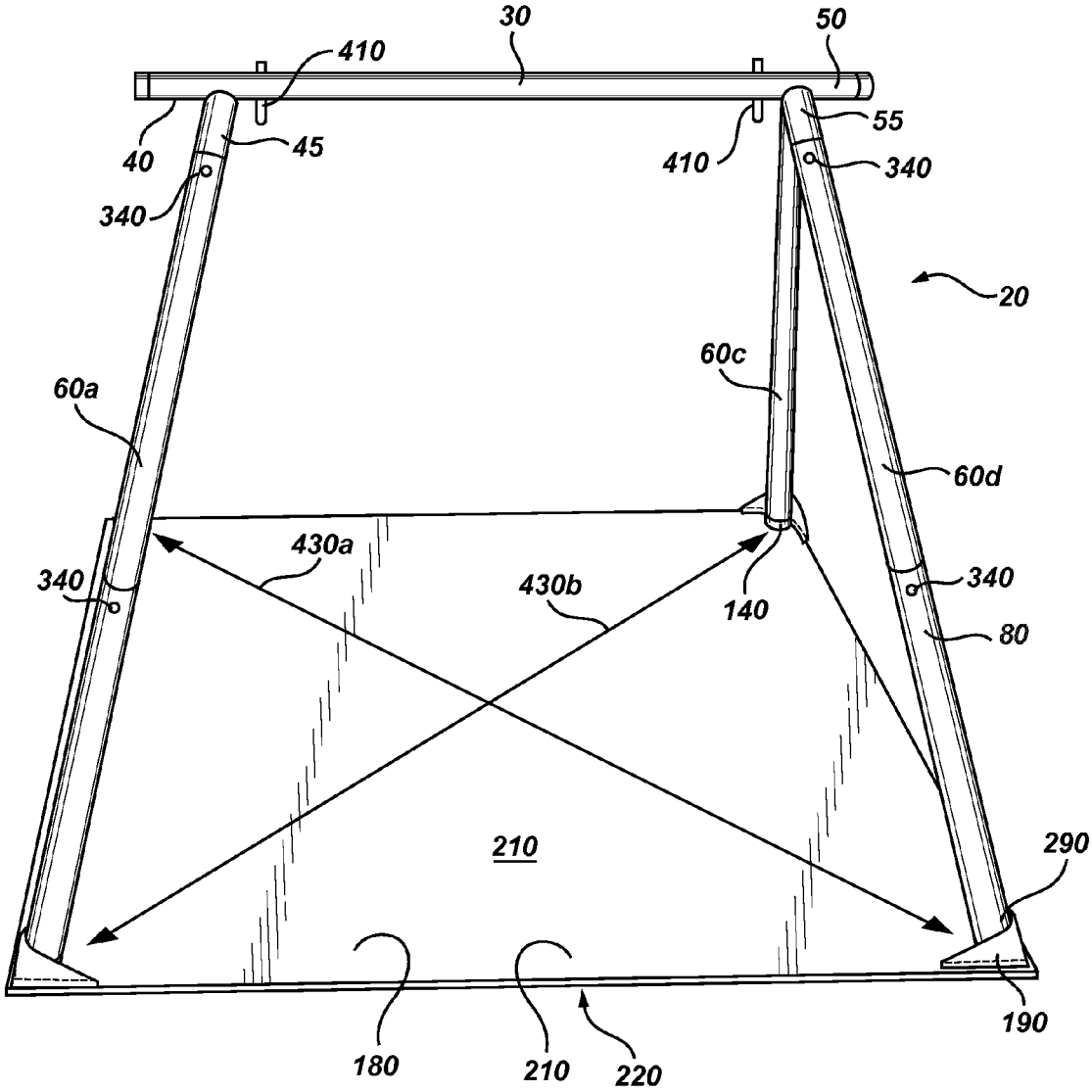
FIG. 6 is front perspective view of an embodiment of the device frame secured in a base showing lateral forces exerted on the base during use.

Referring now to the drawings in greater detail, a preferred embodiment of a therapeutic vestibular swing device 10 is shown. A rigid frame 20 of tubular construction is shown. As depicted, the frame 20 comprises a top shaft member 30 having a first end 40 and a second end 50. A first pair of support members 60 depends outwardly and downwardly from a predetermined location adjacent the first end 40. A second pair of support members 60 depends outwardly and downwardly from a predetermined location adjacent the second end 50. As viewed from the side each pair of support members 60 gives the appearance of an A-Frame. In a preferred embodiment the elongate tubes form the shaft members 30. Tubing provides sufficient strength and rigidity to support the weight of a person during use of the device 10 while also being lightweight and easy to transport. Shaft members 30 and support member 60 may be unitary and constructed from one piece of tubing. In a preferred embodiment the support members 60 are multi-sectioned and formed from a plurality of mating tubular members. Although any number of sections could be used, the support members 60 in the depicted embodiment each have two sections, a top section 70 and bottom section 80. The top section 70 and bottom section 80 are adapted for detachably coupling such that, when assembled, they form a unitary support member 60 that is rigid and capable of supporting the shaft member 30 in cooperation with the other assembled support members 60. Each support member 60 has a shaft end 90 adjacent the shaft member 30 and a foot 140 distal from the shaft end 90.

A detachable base 180 is provided having a plurality of pocket means 190 formed therein or otherwise affixed thereto in predetermined positions. The pockets are arranged in a spaced apart relation such that each pocket means 190 receives one of the feet from one of the support members 60. The base 180 is preferably flexible and may take the form of a carpet mat that may be folded or rolled up easily when not in use. As depicted, the base 180 is rectangular in shape having the pocket means 190 disposed at each corner of the base 180 adjacent the base's 180 outer perimeter. The pocket means 190 may take a variety of forms. In a preferred embodiment the pocket means 190 further comprises a flap 230 of flexible canvas material having a lower hem portion 240 sewn or otherwise affixed through other known means to the base 180 along the base 180 peripheral edge. The flap 230 has an obverse side 260 and an opposite inner side 270 generally adjacent a top surface 210 of the mat. A top portion 250 opposite the lower hem portion 240 is generally upturned such that the upturned flap 230 inner side 270 and the adjacent top surface 210 of the base 180 define a cavity 280 adapted to receive the foot 140 from an individual one of the support members 60. As illustrated, the flap 230 also has a folded-under portion such that the obverse side 260 directly contacts the base 180 top surface 210. This folded-under portion forms a reinforced bottom 265 supporting the foot 140. The reinforced bottom 265 is preferably sewn or otherwise securely affixed to the base 180. The flap 230 also preferably includes a strap 290 releasably securing around a retention portion 160 adjacent the foot 140. The strap 290 is preferably a flexible strap 290 having a pull portion 310 affixed adjacent the flap 230 top portion 250 and an opposite stationary end 300. A releasable securing means releasably secures the strap 290 during use to secure the foot 140 and support member 60 inside the pocket means 190 cavity 280. Any of a variety of releasable securing means may be used such as snaps, buttons, and the like. In a preferred embodiment mating hook and loop patches comprise the releasable securing means. In this embodiment, the releasable securing means comprises a first patch 320 or portion of one of hook and loop material affixed to or adjacent the strap pull portion 310. A second patch 330 or portion of an opposite one of hook and loop material affixed to or adjacent the stationary end 300 of the strap 290 is adapted to releasably engage the first patch 320. The first patch 320 is preferably affixed to an outside portion of the strap 290 while the second patch 330 is preferably affixed to an inside portion. In this embodiment, the strap 290 wraps snugly around the support member 60 outer surface 150 at the support member 60 retention portion 160 so that the strap 290 stationary end 300 overlaps the strap 290 pull portion 310 such that the second patch 330 of hook and loop material overlaps and engages the first patch 320. In this manner the strap 290 further secures the foot 140 and support member 60 into the pocket means 190 cavity 280.

When the pocket means 190 are disposed in the corners of the base 180 as depicted such that the lower hem portion 240 comprises a first hem and a second hem forming a generally tetrahedral or saddle-shaped cavity 280 in conjunction with the upturned top portion 250. In this arrangement the support member 60 further engages the inner side 270 of the flap 230 along the saddle of the flap 230 extending from the corner of the base 180 up to the top portion 250. In this manner the flap 230 generally envelopes the foot 140 and a portion of the support member's 50 outer surface 150 up to the retention portion 160. When four support members 60 are used as depicted in the accompanying Figures, the four respective pocket means 190 affixed to the base 180 place laterally compressive forces 440*a*, 440*b* on the support members 60 and frame 20. While the base 180 is preferably flexible by being foldable or capable of rolling up when not in use, it resists stretching under the lateral loads placed on the base 180 by the frame 20. Thus, when weight is placed on the frame 20, such as the weight of a person using the device 10, the support members 60 tend to spread outwardly relative to horizontal as the frame 20, support members 60, pocket means 190 and base 180 all support the load. Without the pocket means 190 and base 180 support under a load, the frame 20 would encounter significantly higher stresses. Increased stress on the frame 20 without the base 180 and associated pocket means 190 would reduce the weight carrying capacity of the device 10. Thus, the base 180 enables the device 10 to have a smaller footprint than other swings designed to carry the same load. Since the pocket means 190 secures the frame 20 to the base 180, the frame 20 and base 180 become an integral part of the device 10 during operation. In a preferred embodiment utilizing the innovative flexible flap 230 pocket means 190 with the strap 290, the support members 60 are secure and the unitary operation of the frame 20 and base 180 are further ensured during operation. However, the base 180 can be easily and quickly removed or detached from the frame 20 facilitating portability. The load-carrying base 180 also permits the reduction of the frame's 20 structure and footprint enabling the device 10 to be used in environments and locations previously unavailable for vestibular swing therapy use.

To further facilitate portability, the frame 20 is preferably constructed in multiple detachable segments or portions that are easy and fast to assemble and disassemble. In a preferred embodiment, the shaft member 30 has a first pair of offset projections 45 disposed adjacent the first end 40 and a second pair of offset projections 55 disposed adjacent the second end 50 at predetermined locations. As depicted, the shaft member 30 comprises a horizontal piece of tubing. The first pair of offset projections 45 further comprise a first offset member 360*a* and a second offset member 360*b* while the second pair of offset projections 55 comprise a third offset member 360*c* and a fourth offset member 360*d*. These offset members 360 are preferably each formed from equal length pieces of tubing. Each pair of offset members 360 is welded or otherwise affixed in an upside-down v-shape onto the shaft member 30 adjacent the first end 40 and second end 50 respectively in predetermined positions. The tubing pieces of each pair are radially offset from each other in the v-shape, and depend downwardly and outwardly from the shaft member 30. Each offset member 360 is further adapted to detachably couple with an individual one of the support members 60. Each of the support members 60 is likewise preferably constructed from the same type of tubing material as the shaft member 30 and offset projections 45, 55. The shaft members 30 also preferably have a plurality of detachably coupled segments that join to form an individual one of the plurality of shaft members 30. In these preferred embodiments, the frame 20 disassembles quickly into a plurality of component parts that may be placed in a bag, carrying sack, case, or even rolled up in the base 180 for easy transport. In a preferred embodiment, quick detachable coupling means are utilized to join the individual segments of each frame 20 part to their corresponding members so that assembly is fast and efficient with only minimal effort while maintaining rigidity and sturdiness during use. Likewise, the quick detachable coupling means ensures that a therapist or other user can quickly disassemble the frame 20 into component parts after a session with minimal time and effort. Since component parts are significantly easier to transport than an erected swing, applicant believes therapists and others will now be able to use vestibular swing devices 10 as a part of on-site therapy where no permanently placed vestibular swing is available.

In a preferred embodiment, the quick detachable coupling means are mating male members and female members. The frame 20 tubing has a predetermined outside diameter and a predetermined inside diameter. In this preferred embodiment each offset member 360 has an insert portion 85 machined or formed to a smaller diameter than the offset member 360 tubing outside diameter. This insert portion 85 forms the male member component of the detachable coupling means. The support member 60 top section 70 shaft end 90 is interiorly machined yielding an internal diameter greater than the predetermined tubing inside diameter forming the female member. The shaft end 90 is preferably machined to a predetermined depth equivalent to the insert portion 85 length ensuring that the male member seat firmly into the female member while a flange portion of the insert member firmly abuts the top section 70 shaft end 90. The female member is preferably machined to a sufficient depth to ensure a firm connection when the top section 70 is detachably coupled to one of the offset members 360. Each top section 70 further has a member end portion 100 opposite the shaft end 90. This member end portion 100 is similarly machined to form a male member similar to the offset member 360 insert portion 85. The support member 60 bottom section 80 has a machined receiver 120 end portion forming a female member adapted to slidably receive the male member end portion 100. Thus, each multi-section support member 60 preferably detachably couples in the same manner that the support member 60 detachably couples with an offset member 360.

To ensure the detachable coupling means remains coupled during use, snap buttons 340 are used to selectively lock the male member and female member when they are coupled. Snap buttons 340 ensure that the male member and female member do not separate when they are coupled. Snap buttons 340 also prevent the relative rotation of the male and female members during operation. In these embodiments, the snap button 340 is disposed within the male member with the button portion protruding through an orifice in the male member. On depressing the button the male member inserts into the female member. When the male member is fully seated in the female member the snap button 340 protrudes through a mating second orifice disposed on the female member. The male member may be easily removed from the female member by depressing the snap button 340 through the second orifice and sliding the male member and female member apart. In the depicted embodiment, a snap button 340 is disposed within each of the offset member 360 and the member end 100 of each top section 70. Other embodiments may use alternative means of selectively locking the male member and the female member, such as cotter pins, clevis pins, hitch pins, dowels or the like.

A rectangular platform seat 370 suspends centrally from the shaft member 30 via a suspension means. Rope or chain may be used as the suspension means to suspend the seat 370 from the frame 20. The seat 370 may be formed from a variety of materials including molded plastics, cut-to-shape plywood, or the like. In a preferred embodiment the seat 370 is constructed from plywood cut in a rectangular shape and of sufficient size to form a comfortable and stable seat 370. A sheet of padded fabric, leather, vinyl or the like envelopes the seat 370 providing cushioning and minimizing sharp edges. In a preferred embodiment a first mounting means 410 and a second mounting means 410 are disposed on the shaft member 30 in a predetermined spaced apart relation. A spacing distance less than the width of the seat 370 is preferred, although spacing equal to or greater than the seat 370 width may also be utilized with varying performance. A first eyebolt and a second eyebolt are depicted as the first mounting means 410 and second mounting means 410, respectively. A first rope 390 has an end affixed to a front seat 370 corner while the opposite end is affixed to a rear seat 370 corner. A second rope 400 also has an end affixed to a second front corner of the seat 370 while the opposite end is affixed to a second rear corner of the seat 370. The first rope 390 terminates in a slip connector 425*a* approximate the rope's center point connected to the first eyebolt while the second rope 400 terminates in a second slip connector 425*b* connected to the second eye bolt. In lieu of ropes, other embodiments may utilize chain or cable. Where chain or cable is utilized, either a soft foam padding, plastic or PVC tubular casing, or soft vinyl or plastic tubing encase the chain or cable to prevent injury or hair entanglement in the individual chain links or cable splice locations. In rope or chain embodiments, seat 370 height adjustment may also be obtained by using a different individual chain link connected to an S-hook further suspended from one of the eyebolts. Alternately, a short length of chain may suspend from the eyebolts with the slip connecter further attached to the bottom of the length of chain. In these embodiments, using different individual links in the chain in the same manner as embodiments utilizing chains as the suspension means make height adjustment possible. In yet other embodiments, a single, centrally disposed eyebolt may be utilized wherein the first slip connector 425*a* and the second slip connector 425*b* (or first and second suspension means respectively) both affix or attach to the eyebolt. This embodiment would permit rotational use of the swing Child safety is important in use of the device 10. To enhance the actual and perceived safety of the device 10, soft foam tubular padding is placed around the frame 20 members ensuring that bumps against the frame 20 are soft and dampened. The padding also covers the individual connection means in multi-segmented embodiments preventing the possibility injury at these joints during use.

As previously described, the frame 20 members are preferably constructed from low-weight, high strength metal tubing such as aluminum. However, other high-strength tubular metals or materials may be utilized as well. For portability, low-weight materials ensure the device 10 is easy to carry. While round tubing is depicted in the illustrated embodiments, rectangular or triangular tubing may also be utilized. Alternative embodiments may also utilize other detachable coupling means for detachably coupling the multi-segmented frame 20 parts. Feasible alternatives to the machined male and female members may include a flared female member adapted to receive a male member having an outside diameter slightly less than the inside diameter of the flared female. As another alternative, tubing may be selected that is slightly different in outer and inner diameters such that the smaller diameter tubing slides inside the larger tubing so that machining or flaring is not required. In such an embodiment, the smaller male member tubing should be selected to have an outside diameter just less than the inside diameter of the female member. This selection allows the close sliding frictional fit to be maintained. The use of the snap buttons 340 or other selective locking means is also preferred in these embodiments since the snap button 340 prevents rotational and longitudinal movement of the coupled members during use.

The illustrated base 180 in a preferred embodiment is a durable carpet mat 200 or piece. An applied or affixed rubberized bottom surface 220 is preferred and prevents slippage during use. A carpeted top surface 210 provides a soft, padded surface that facilitates safe use while also presenting an attractive appearance. The carpet base 180 provides sufficient resistance to stretching to ensure the frame 20 does not yield outwardly during use but is instead constantly urged inwardly for added rigidity and stiffness. Other heavy-weight fabrics or fabric constructions may be used in alternative embodiments provided they provide sufficient resistance to stretching during use. Likewise, alternate embodiments may include differing flap 230 constructions. Flap 230 material is preferably somewhat flexible, and may be supple or resilient depending on construction. Canvas or other heavy fabric material may be utilized, or coated fabric may be used. In a preferred embodiment, a fabric or fiber-reinforced rubber flap 230 is preferred as it offers sufficient strength, flexibility, and load bearing characteristics.

As has been demonstrated, the present invention provides a novel therapeutic vestibular swing device 10. The novel base 180 having affixed or integrated pocket means 190 ensures stability by sharing the load with the frame 20 allowing for smaller frame 20 members and a reduced footprint. The novel base 180 further comprises a novel pocket means 190 for retaining the frame 20 support members 60 and sharing the load between the base 180 and the frame 20.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

We claim:

1. A therapeutic swing device comprising:

a rigid frame comprising a shaft member having a plurality of rigid support members depending radially downwardly in spaced apart relation; each of the support members having a foot distal from the shaft, an outer surface, and a retention portion adjacent the foot;

a detachable lateral load-bearing flexible base supporting each foot, the base further comprising a plurality of pocket means in a predetermined spaced apart relation, each individual one of the pocket means adapted for detachably receiving an individual one of the plurality of support member feet and urging the support members in lateral compression;

a generally rectangular seat having at least a generally flat sitting surface for supporting a user, the seat pivotally suspended from the frame by a suspension means.

2. The therapeutic device according to claim 1 wherein the load-bearing base further comprises a flexible mat having a top surface and a bottom surface.

3. The therapeutic device according to claim 2 wherein each of the pocket means further comprises: a flexible flap having lower hem portion affixing the flap to the base, and a distal top portion; an obverse side and an inner side; the base, the lower hem and inner side forming a cavity therein for receiving the foot; a strap releasably securing an individual one of the support members into the pocket, the strap having a first end fixed adjacent the top portion and a second end releasably securing to the top portion.

4. The therapeutic device according to claim 3 wherein the securing strap is formed of flexible material.

5. The therapeutic device according to claim 3 further comprising a first patch of one of releasable hook and loop material fixed adjacent the flap obverse side top portion, and a second patch of an opposite one of releasable hook and loop material fixed to the strap second end such that the flap inner side top portion and strap envelope a secured portion of the structural member when the strap is releasably securing the structural member and foot into the pocket.

6. A therapeutic device according to claim 3 wherein the flap is comprised of woven fibers.

7. A therapeutic device according to claim 3 wherein the flap comprises fabric reinforced rubber sheeting.

8. A therapeutic device according to claim 3 wherein the flap further comprises a reinforced bottom portion folded under the flap and affixed to the bottom such that the foot rests on the reinforced bottom.

9. A therapeutic device according to claim 1 further comprising: the shaft having a first end and an opposite second end, a first pair of radially offset projections depending downwardly and outwardly adjacent the first end, a second pair of radially offset projections depending downwardly and outwardly adjacent the second end; wherein each individual one of the plurality of support members detachably couple to an individual one of the first or second pair projections.

10. A therapeutic device according to claim 1 wherein each of the plurality of support members have at least a top section and a bottom section; the top section having a shaft end, and a member end, and a first coupling means proximate the shaft end, for detachably coupling the shaft to the shaft end; and the bottom section having a receiver opposite the foot, and a second coupling means proximate the receiver for detachably coupling to the member end.

11. A therapeutic device according to claim 10 wherein the first coupling means comprises a spring-clip protruding from the shaft for engaging the shaft end.

12. A therapeutic device according to claim 11 wherein the second coupling means comprises a spring-clip protruding from the member end for engaging the receiver.

13. A therapeutic device according to claim 1 wherein the base further comprises a flexible mat having a non-skid bottom surface.

* * * * *